US008567561B2

(12) United States Patent
Strasser et al.

(10) Patent No.: US 8,567,561 B2
(45) **Date of Patent: *Oct. 29, 2013**

(54) PERSONAL ESCAPE DEVICE AND METHODS FOR USING SAME

(75) Inventors: Michael Strasser, San Francisco, CA (US); Thomas King, San Francisco, CA (US); Kevin R. Stone, Mill Valley, CA (US)

(73) Assignee: Rescue Reel, LLC, San Francisco, CA (US)

( * ) Notice: Subject to any disclaimer, the term of this patent is extended or adjusted under 35 U.S.C. 154(b) by 899 days.

This patent is subject to a terminal disclaimer.

(21) Appl. No.: 12/218,922

(22) Filed: Jul. 18, 2008

(65) Prior Publication Data

US 2010/0065373 A1 Mar. 18, 2010

Related U.S. Application Data

(60) Provisional application No. 60/950,451, filed on Jul. 18, 2007.

(51) Int. Cl.
*A62B 1/10* (2006.01)

(52) U.S. Cl.
USPC ..... 182/234; 182/239; 182/72

(58) Field of Classification Search
USPC ..... 182/234, 239, 72
See application file for complete search history.

(56) References Cited

U.S. PATENT DOCUMENTS

| | | | | | |
|---|---|---|---|---|---|
| 657,641 | A | * | 9/1900 | Buddenbohn | 182/239 |
| 660,792 | A | * | 10/1900 | Gail | 182/234 |
| 825,506 | A | * | 7/1906 | Barsalon | 182/239 |
| 839,974 | A | * | 1/1907 | Warfield | 182/235 |
| 1,117,098 | A | * | 11/1914 | Sherman | 182/239 |
| 3,596,754 | A | * | 8/1971 | Peterson, Jr. | 206/184 |
| 3,760,910 | A | | 9/1973 | Koshihara | |
| 3,915,432 | A | * | 10/1975 | Bustamante | 182/239 |
| 3,946,989 | A | | 3/1976 | Tsuda | |
| 4,457,400 | A | | 7/1984 | Donaldson et al. | |
| 4,480,716 | A | | 11/1984 | Soubry et al. | |
| 4,493,396 | A | | 1/1985 | Borgia | |
| 4,602,699 | A | * | 7/1986 | Matt | 182/234 |
| 4,714,208 | A | | 12/1987 | Holahan et al. | |
| 4,722,422 | A | | 2/1988 | Hiraoka | |
| 4,938,435 | A | * | 7/1990 | Varner et al. | 244/142 |
| 4,998,683 | A | | 3/1991 | Wendelborn | |
| 5,076,395 | A | | 12/1991 | Kikuchi | |
| 5,842,542 | A | | 12/1998 | Tien | |
| 6,363,244 | B1 | | 3/2002 | McGhee et al. | |

(Continued)

FOREIGN PATENT DOCUMENTS

| | | | | | |
|---|---|---|---|---|---|
| JP | 0407 5671 | A | * | 3/1992 | A62B 1/08 |

*Primary Examiner* — Alvin Chin Shue
(74) *Attorney, Agent, or Firm* — Lathrop & Gage, LLP

(57) ABSTRACT

The invention presents devices for controlled descent from buildings. Such a device includes a housing having a primary spool about which a cord is wound, a payload coupler for attaching a harness assembly to the housing, and an unwind control assembly for controlling the rate of exit of the cord from the housing. An inventive device kit may include a convertible storage unit used to protectively store a device and which, upon deployment, may be used as a protective helmet. In using an inventive device, a user attaches the device to a fixture in a building, dons a harness and the converted helmet, attaches the device to the harness, and exits the building from a window or roof.

14 Claims, 17 Drawing Sheets

(56) References Cited

U.S. PATENT DOCUMENTS

| | | | | |
|---|---|---|---|---|
| 6,446,809 | B2 * | 9/2002 | Flynn | 206/523 |
| 6,745,872 | B2 | 6/2004 | Sato | |
| 6,868,942 | B2 | 3/2005 | Barzilai et al. | |
| 6,962,235 | B2 | 11/2005 | Leon | |
| 6,988,587 | B1 | 1/2006 | Smith | |
| 7,237,651 | B2 | 7/2007 | Avots | |
| 2002/0023085 | A1 * | 2/2002 | Keith, Jr. | 707/5 |
| 2005/0023085 | A1 * | 2/2005 | Munton | 182/239 |
| 2005/0039981 | A1 | 2/2005 | Wooster et al. | |
| 2006/0065485 | A1 | 3/2006 | Reed | |
| 2006/0096807 | A1 | 5/2006 | Lee | |
| 2007/0246298 | A1 | 10/2007 | Botti | |

* cited by examiner

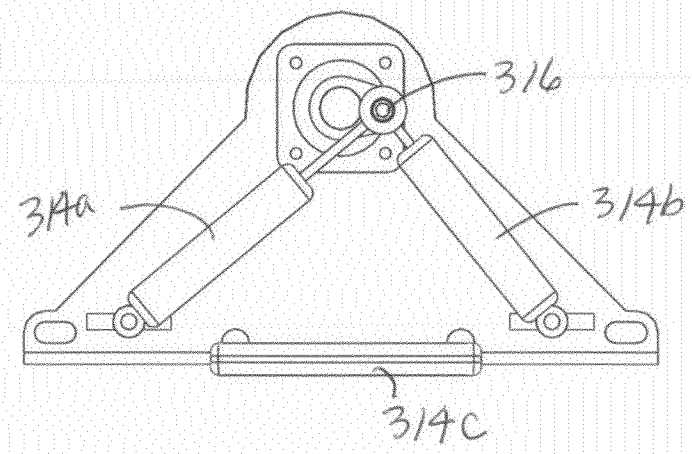
FIGURE 6C - position 2
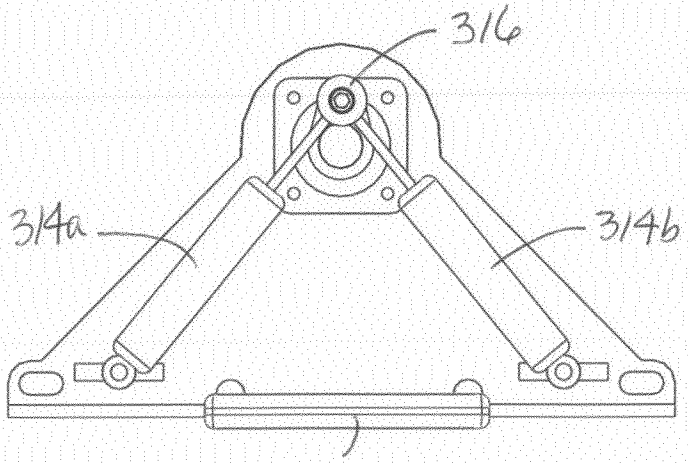
FIGURE 6B - position 1

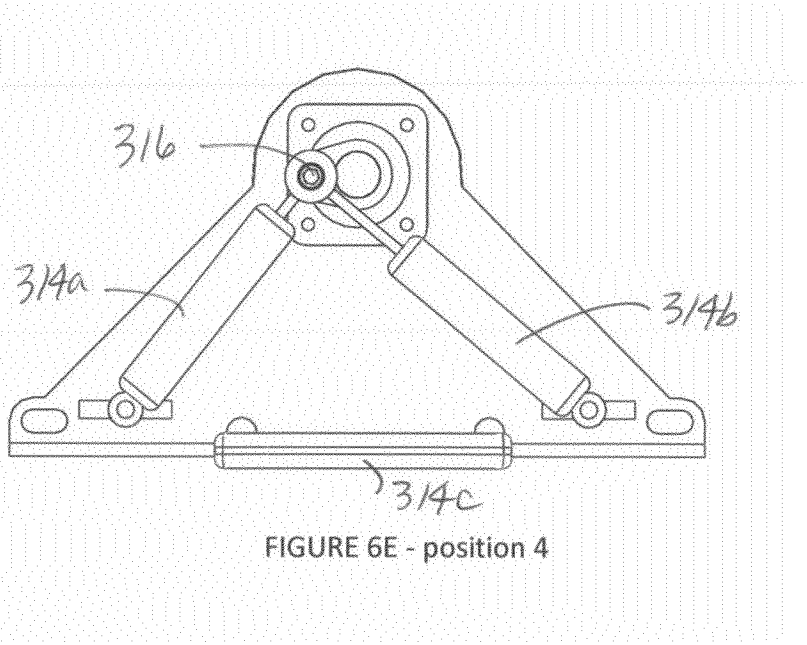
FIGURE 6E - position 4
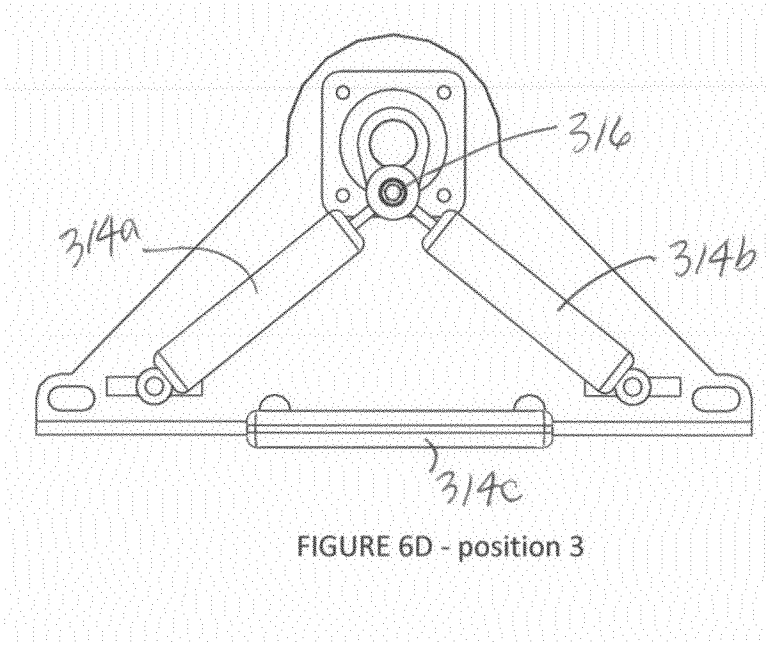
FIGURE 6D - position 3

PERSONAL ESCAPE DEVICE AND METHODS FOR USING SAME

CLAIM OF PRIORITY

This application claims priority to U.S. provisional application Ser. No. 60/950,451, filed Jul. 18, 2007, incorporated herein fully by reference.

FIELD OF THE INVENTION

The present invention relates to emergency equipment and personal safety devices involving exiting a tall building in event of an emergency.

BACKGROUND

Each year, an estimated ten thousand fires occur in buildings that are seven stories or higher. Hundreds of firefighters and police risk their life every day by entering burning buildings to save trapped civilians. Additionally, terrorism, hostage situations, and violent crime rampages worldwide are increasing, often leaving people trapped high above the streets, waiting for rescue.

An estimated 2,726 people died on Sep. 11, 2001, at the World Trade Center in New York City. Of that number, 343 were firemen who entered the building to save lives. An estimated 200 people were trapped civilians who willingly jumped from the buildings before the buildings collapsed. Though 9/11 was an extreme situation, it is not uncommon for victims of high rise fires to jump as a last resort to escape smoke and fire. For many fire victims, exit routes are too slow or inaccessible due to extremely hot flames and smoke. For overweight or physically impaired individuals, stairs are not an option. Too frequently victims are trapped and forced to wait for rescue.

Over the years, many devices have been created attempting to address the problem of controlled descent in an emergency situation, either to prevent work-related falls or for emergency descent from buildings. Many of these prior art devices rely solely upon hydraulic or other fluid braking systems. Such devices have a relatively short life, depending on the nature of the fluid, and risk failure due to low or insufficient fluid levels. Because emergency situations rarely occur, and even more rarely occur more than once for a single building, emergency devices must be able to be stored for extended periods of time without maintenance without any risk of degradation of functionality. Other prior art devices are manual in nature. U.S. Pat. No. 5,842,542, uses a manual braking system, such as a rope windlass system, to slow the passage of a rope as the person descends. However, wear on the rope caused by the friction of the manual braking system makes such a system dependent upon the abilities of the user, thus are less reliable for members of the population who do not have the capacity to exert sufficient force to slow the descent.

Yet other prior art devices include a complexity of mechanics to make them unwieldy and inherently less reliable. Such devices are found in U.S. Pat. No. 3,946,989, and U.S. Pat. No. 6,745,872. Not only are such complex mechanisms expensive to manufacture, the multiple parts makes them inherently unreliable. Similarly, prior art devices that include spring mechanisms, such as that found in U.S. Pat. No. 3,760,910, include an element that may not store over time, may break under certain heavier weights, or may not extend sufficiently under certain lighter weights.

Thus, there remains a need for a reliable device for enabling the controlled descent of persons of a range of ages, weights, and abilities from high buildings in emergency situations.

SUMMARY OF THE INVENTION

The present invention provides a personal escape device, which can be used by men, women, children, and physically disabled persons to descend in a controlled and secure manner from high structures, such as office buildings, homes, and the like.

A device of the present invention includes a housing, having a port therein. A primary spool extends along a central axis within the housing opposing the port, and is rotatably coupled to the housing to permit rotation of the primary spool about the central axis. An inventive device further includes an elongated cord, wound around the primary spool, having its proximal end affixed to the primary spool and the distal end extending through the port. An inventive device further includes an anchor assembly extending from the distal end of the cord, which assembly includes some means for coupling the distal end to an external object, such as a door, structural beam or pillar, or other secure structural object in a building.

A payload coupler is affixed to the housing for attaching or otherwise receiving a harness assembly designed to support a payload, such as an individual. An inventive device includes an unwind control assembly, which includes means for controlling the rate of exit of the cord from the housing at a predetermined function rate in response to a substantially constant pulling force on the distal end of the cord.

An unwind control assembly of the device may include a centrifugal clutch, a hydraulic damper, an air damper, a user-controllable disc or drum brake, a hysteresis brake, an electromagnetic brake, an eddy current brake, or other similar assemblies generally commercially available. Unwind control assemblies may be disposed on an idler shaft coupled to the housing and extending parallel to the central axis, and may be connected by a coupling assembly between the primary spool and housing. Coupling assemblies may include a direct connection, a gear assembly, a chain and sprocket assembly, a belt and pulley assembly, or other similarly functioning coupling assemblies generally known and commercially available.

An elongated cord of the present invention may consist of a high strength cable made of a high abrasion resistance material or having a high abrasion resistance coating. In an embodiment, the cord has a portion at or near the distal end manufactured from or coated with a relatively high abrasion resistance compared to the remainder of the cord. A payload coupler of the device may include an impact-absorbing member adapted to be coupled in line between the housing and a harness assembly. The impact absorbing member may be a resilient elastic cord, such as that used in a robust bungee cord. The payload coupler may be attached to a harness coupler for attaching a payload-supporting harness. The harness may include a net, platform, universal step-in harness assembly, or other means of securing a payload, such as a human, animal, or inanimate objects. The harness coupler may be selectively operable, so that a user may self-attach the harness to the payload coupler.

An inventive device may further include a secondary spool on an idler shaft extending along an axis parallel to the central axis. In such a device, the cord is wound at least once around the secondary spool between the primary spool and the port. An inventive device may include a dashpot coupled between the primary spool and the housing.

A device of the present invention may be employed by a user to escape from, or evacuate, a building in times of emergencies, such as those associated with the 9/11 event. To escape from a building, the anchor assembly is affixed to a structurally secure object or connection in the building. Then, the user opens or breaks open a window, and employs the escape device of the invention. Next, the user attaches a harness assembly to the payload coupler (if not already attached). Next, the user enters the harness assembly and, while holding the housing of the escape device, exits through the window. In response to the gravity-induced (by the weight of the user) force on the distal end of the cord, the cord exits through the port in a controlled manner, allowing the user in the harness assembly (and the housing) to descend, at a controlled rate to ensure a controlled descent.

The present invention further provides a personal escape kit, including a personal escape device together with a convertible storage unit. The storage unit includes an outer impact-resistant storage housing, which may be converted to a helmet-like head protector for a user. By way of example, when the storage unit is a "clam-shell" structure having two opposed sections connected on one side by a hinge, the user may separate the two sections and place one section on his/her head, using it as a protective helmet. In such embodiments, the section-to-be-used-as-a-helmet includes an inner structure adapted to couple the helmet to a user's head with an energy-absorbing structure such as a plastic "harness" or foam pads as might be found in a football helmet. With this structure employed, a user might safely descend from a high floor in a building while using the "helmet" to protect his/her head from falling debris. Preferably, the outer contour of the storage housing is shaped so that a plurality of such storage housings (each including an escape device of the invention) may nest together for compact storage.

Although the present invention is defined broadly above, it will be appreciated by those skilled in the relevant art that it is not limited thereto but includes embodiments of which the description provides examples.

BRIEF DESCRIPTION OF THE FIGURES

FIGS. 6B-6E are illustrations of hydraulic damper configurations for use in a personal escape device in accordance with certain embodiments of the invention.

DETAILED DESCRIPTION OF THE INVENTION

The present invention is a personal escape device that allows a person, animal, or inanimate object to be lowered in a controlled or controllable manner from a high location. The device is designed for a relatively low-cost, small size which may be used by payloads of variable weights.

Figure 1:
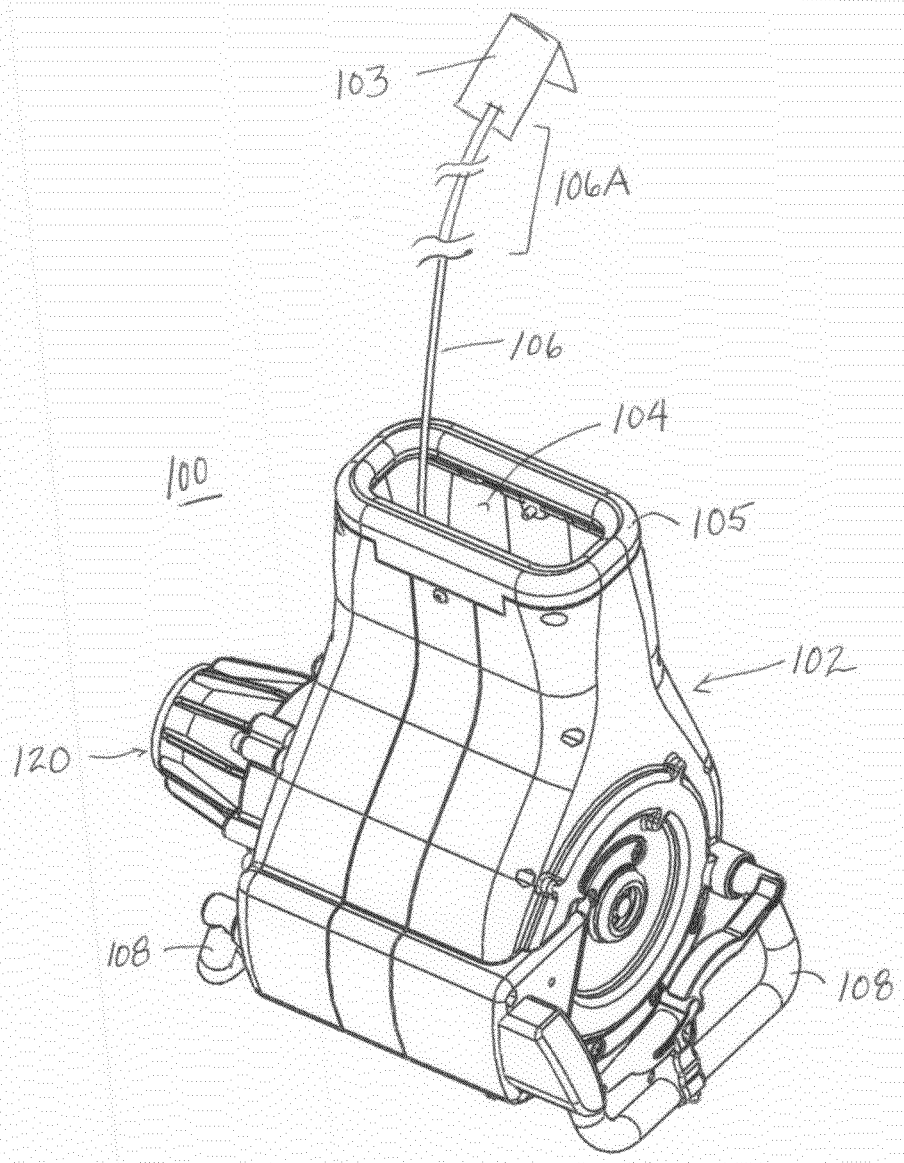
FIG. 1 is a perspective view of a personal escape device in accordance with certain embodiments of the invention.

An embodiment of the personal escape device of the present invention is illustrated in FIG. 1. As shown, the personal escape device 100 includes a housing or casing 102 manufactured from substantially rigid, formable or moldable materials, such as fiberglass, plastics, rigid metals, or other materials generally commercially available. The housing material should be of sufficient strength to withstand both force applied by the weight of the payload during deployment, and by the friction of the cord as it is deployed.

As described below, a primary spool 110, rotatable about a central axis A, is disposed within the housing 102, although not shown in FIG. 1. A cord 106 is wound around spool 110, with its proximal end affixed to the spool 110 and its distal end coupled to an anchoring assembly 103. The housing includes a port 104 of sufficient size to enable a cord 106 to extend therethrough.

In the illustrated embodiment of FIG. 1, the port 104 is oblong shaped to permit the cord 106 to travel across the aperture length. Depending on the materials of the housing and of the cord, the port shape may be adapted to accommodate lateral movement of the cord during deployment. Allowing some lateral movement of the cord 106 as it is deployed reduces the amount of friction by the port edges on the cord during deployment and helps prevent jamming of the cord 106 as it is unrolled from the spool 110. Alternatively, the port 104 may be round or oval in shape. The external edges of the port may be reinforced with a port guard 105, made of a low friction material, for example, a Teflon material, to minimize frictional wear of the edge and the cord during payout of the cord from spool 110 in deployment of the device 100.

Also as shown in FIG. 1, the device 100 includes user handles 108 on one or both sides of the housing. During deployment, the user may hold onto these handles 108 for stability. These handles may be in any shape or type sufficient for a user to place his/her hands during descent. In those events of long descent (e.g., 100 stories), these handles assist the user in executing a non-rotational descent. In alternative embodiments, external handles may be omitted and the housing may include integral extensions for the user's hand support, or the user may hold onto the casing directly.

Figure 2:
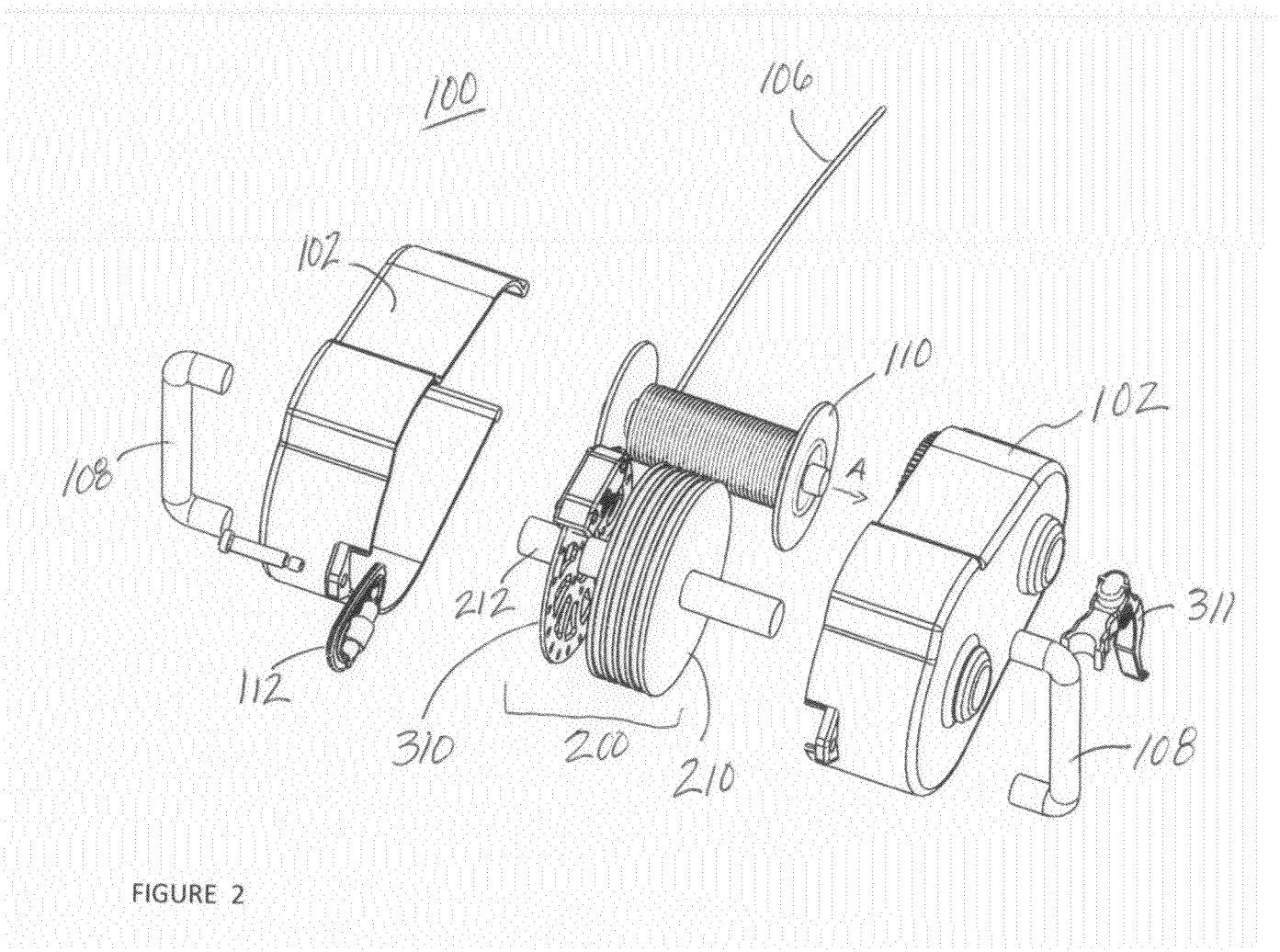
FIG. 2 is an exploded perspective view of the personal escape device of FIG. 1.

As shown further in FIG. 2, the housing 102 may be manufactured from two halves for ease of assembly. Alternatively, the housing 102 may be die cast or otherwise manufactured in one or more pieces. As shown in the illustrated embodiment, the device includes a spool 110, extending along a central axis A, around which the cord 106 is wound for pre-deployment storage. The outermost diameter of cord wound on the spool 110 will vary depending upon the length of cord which it holds. The spool 110 is rotatably mounted to and extends between the two halves of the housing 102, such that as the cord 106 is pulled by the weight of a user during deployment, the spool 110 rotates around central axis A sympathetically with the weight to release length of cord 106 at a controlled rate.

The inventive device 100 may include a dashpot 120 coupling the primary spool 110 to the housing 102. The dashpot 120 resists motion of the spool 110 via viscous friction to further enhance controlled payout of the cord 106 during use. The resulting force from inclusion of the dashpot 120 is proportional to the velocity, but acts in the opposite direction, slowing the motion and absorbing energy.

Figure 3:
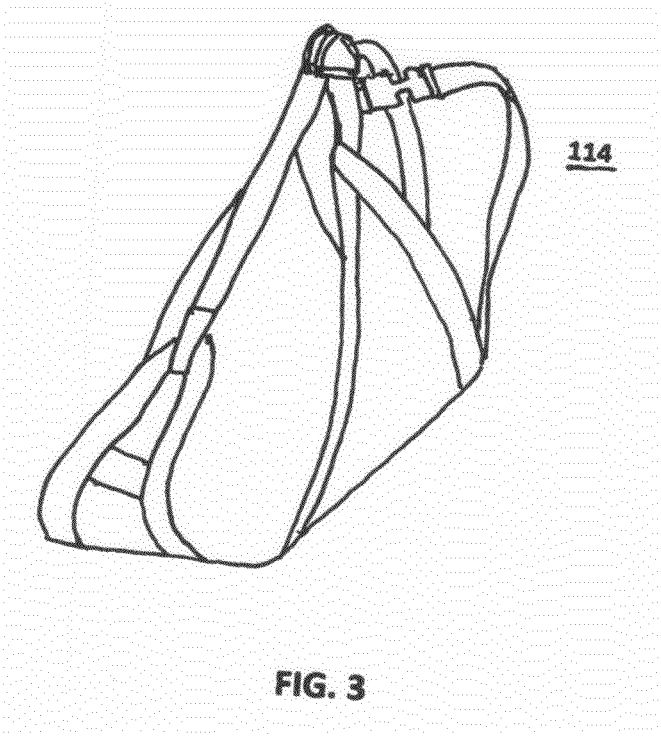
FIG. 3 is a perspective view of a harness assembly of a personal escape device in accordance with certain embodiments of the invention.

Also as illustrated in FIG. 2, the housing 102 includes a payload coupler 112, such as a carabiner, for selectively attaching a harness 114, such as shown in FIG. 3. The coupler 112 may be secured to the housing 102, to the handles 108, or may be an aperture integral with the housing 102. The coupler 112 is of sufficient strength and durability to securely attach a payload-bearing harness 114 to the housing 102.

The distal end of cord 106 is coupled to anchor assembly 103 which, in the illustrated embodiment, is in the form of a "hook-like" structure for attachment to the hinged edge of a door of a building. Other forms of the anchor assembly may be used in other embodiments, for example a resilient arm C-clip might be used to couple the distal end to a hook extending from a structural beam of a building.

In the embodiment of FIG. 1, the portion 106A of cord 106 near its distal is characterized by a high abrasion resistance, compared to the remainder of cord 106.

The illustrated harness 114 of FIG. 3 may be an easy step-in type harness that is adjustable to various weights and sizes of users. Such harnesses are generally available and may be of the type used by rock climbers or by rescue teams. They may be of a sling-type for carrying animals and inanimate objects, or secure harnesses such as the type shown. A harness 114 of the present invention has some hook, loop, strap, aperture, or other means of attaching to the payload coupler 112 of the inventive device. Preferably, such harness is manufactured from or treated with a fire-retardant material.

The inventive personal escape device 100 further includes an unwind control assembly 200 that controls the rate of exit, or payout, of the cord 106 from around the spool 110 to be at a controlled rate, for example, predetermined function of time in response to a substantially constant pull force at the distal end of the cord, such as gravity-generated by any payload in the harness during deployment. The controlled rate may have a specific time profile or it may be any rate subject to or below a predetermined maximal value.

An embodiment of the unwind control assembly 200 of the inventive device includes a geared centrifugal clutch system 210 effecting a dynamic braking mechanism. In that embodiment, a centrifugal clutch is disposed on an idler shaft 212 coupled to the housing 102. In the illustrated embodiment, the clutch system 210 is connected to the spool 110 by a coupler assembly 214, which may be a gear assembly (planetary or helical), direct connection, chain and sprocket assembly, belt and pulley assembly, or other assembly generally available. An exemplary chain and sprocket coupling assembly for assembly 214 resides within the housing 102 (not shown in FIG. 2, but shown in plan view in FIG. 4A.) Equivalent gear assemblies and belt and pulley assemblies may readily be made and used in place thereof.

Figure 2A:
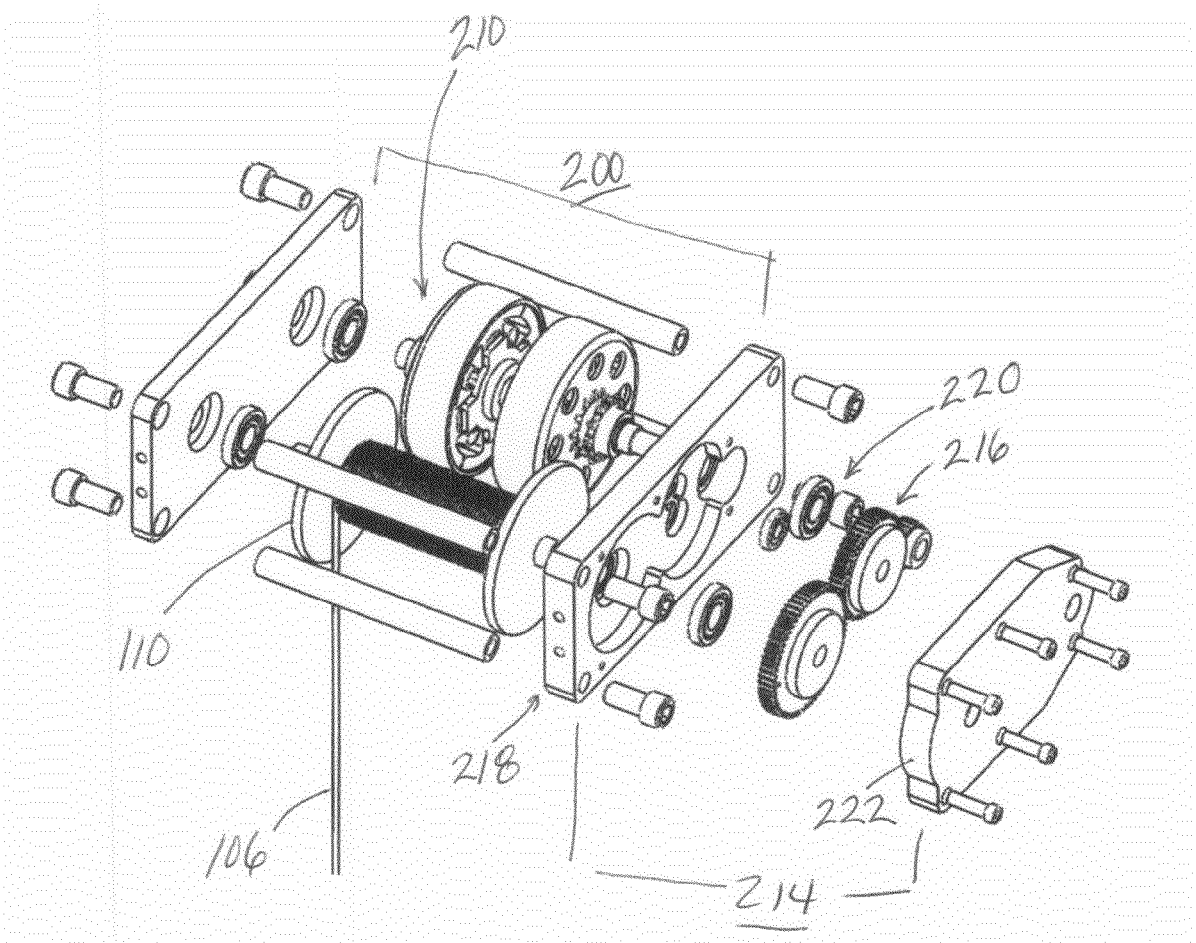
FIG. 2A is an exploded perspective view of an exemplary unwind control assembly and coupler assembly of the personal escape device of the invention.

FIG. 2A shows an embodiment of the invention having an unwind control assembly 200 including a centrifugal clutch system 210 and coupler assembly 214. In the illustrated embodiment, the coupler assembly includes planetary gear assembly 216 disposed in a gearbox formed by a gearbox base 218 and gearbox cover 222. Ball bearing 220 is illustrative of the bearings of both spool 110 and the idler shaft supporting centrifugal clutch system 210.

In an embodiment, the coupling assembly 214 steps up the rpm of the spool 110 using gears, chain and sprocket, or belt and pulley configurations. The centrifugal clutch system 210 enables braking force to increase as the spool rpm increases. Thus, during deployment of the device 100, the geared centrifugal clutch system 210 steps up the rpm of the spool enabling smaller and lighter centrifugal clutch systems to be used in the device 100. In addition, the centrifugal clutch system 210 enables the creation of drastically different braking forces with little changes in descent speed. For example, the spool 110 may spin at 1000 RPM and the clutch 210 at 4000 rpm (4 times the spool speed). If the spool 110 rpm increases to 1500 rpm, then the rpm of clutch 210 would increase to 6000 rpm. The 2000 rpm increase in clutch speed for only 500 rpm increase in spool speed allows for a much higher production of brake forces. By steepening the rpm curve, the braking force increases dramatically as the spool rpm increases. This geared centrifugal clutch system 210 allows the device 100 to handle a wide range of user weights without adjustment with consistent descent speeds. Such geared centrifugal clutch systems 210 are generally commercially available from a variety of sources.

Alternative unwind control assemblies 200 may include hydraulic or air damper systems, centrifugal clutch systems, user-controllable disc or drum brakes, electromagnetic brakes, eddy current brakes, and other common friction braking systems known or available. In addition, a planetary or helical gearbox may be used in an unwind control assembly 200 to alter braking torque and rpm.

Figure 4:
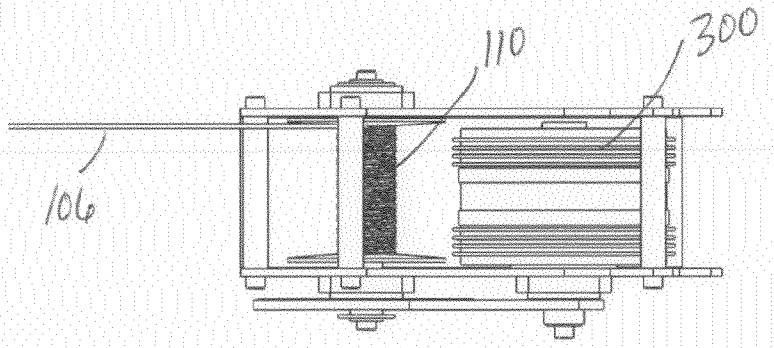
FIG. 4 is a top perspective view of a hysteresis brake assembly for use in a personal escape device in accordance with certain embodiments of the invention.
Figure 4A:
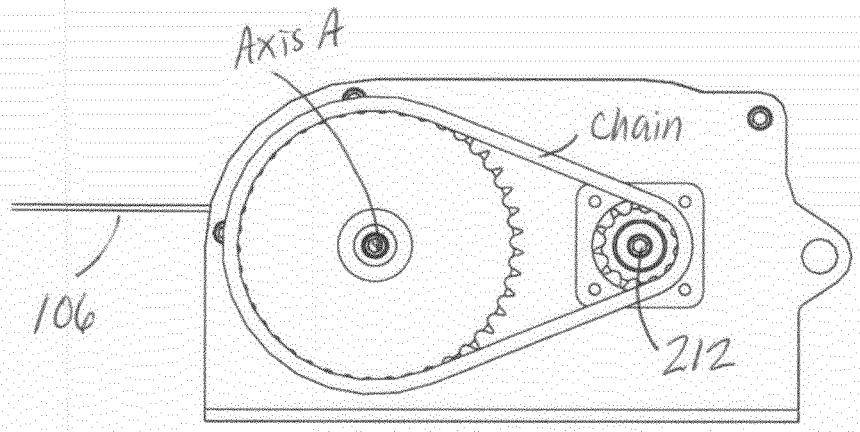
FIG. 4A shows a plan view of an exemplary coupling assembly.

Another unwind control assembly 200 that may be used in the inventive device 100 is a hysteresis brake 300 shown in FIG. 4. Magnetic hysteresis brakes include magnet assemblies surrounding a hysteresis disc, and work on the principle that when like poles face each other, they produce maximum magnetic saturation, forcing lines of flux to travel circumferentially through the hysteresis disc. This movement produces maximum torque (translating to braking forces.) An exemplary chain and sprocket form for coupling assembly 214, with exemplary step-up, is shown in FIG. 4A.

Figure 5:
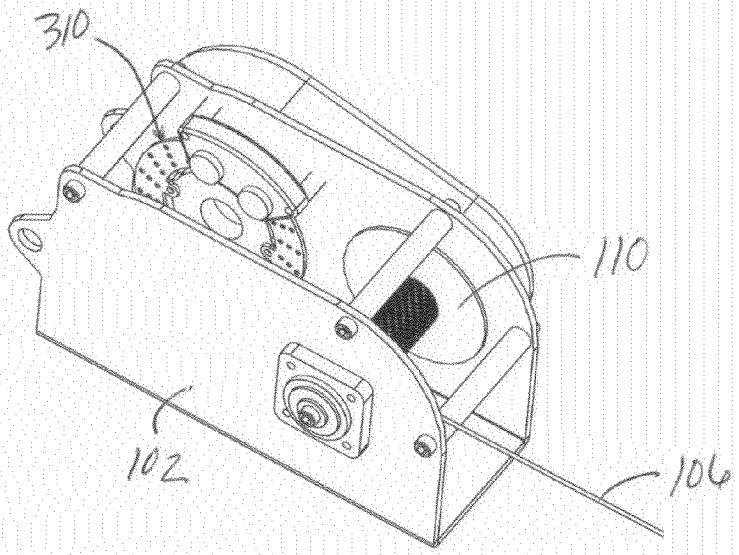
FIG. 5 is a perspective view of a small drum or disc brake assembly for use in a personal escape device in accordance with certain embodiments of the invention.
Figure 5A:
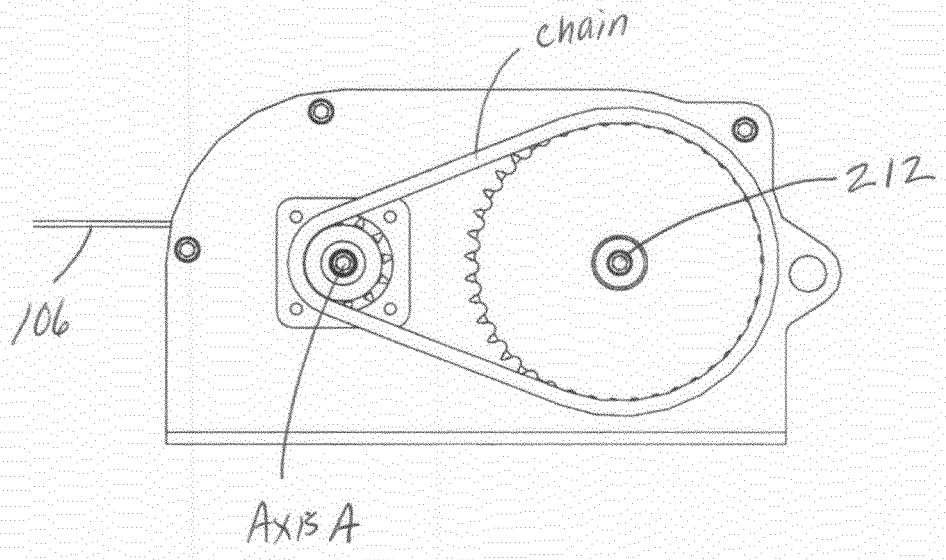
FIG. 5A shows a plan view of an exemplary coupling between a disc brake and the handle of the embodiment of FIG. 1.

In addition to unwind control assembly 200, the illustrated embodiment of FIG. 5 includes a manually- (or user-) operated brake system 310. That system 310 may be in the form of a disc brake system (as illustrated) or any drum brake system, both as commonly found on a motorcycle. These types of brake systems 310 are designed to handle high torque loads and to dissipate the heat generated by use of device 100. The strength of a brake system 310 of this type allows for gearing up the system to slow the brake rotor. The brake system 310 may be operated by a user using handle 311. An exemplary chain and sprocket form for coupling the disc brake system 310 to the handle 311 is shown in FIG. 5A.

Figure 6A:
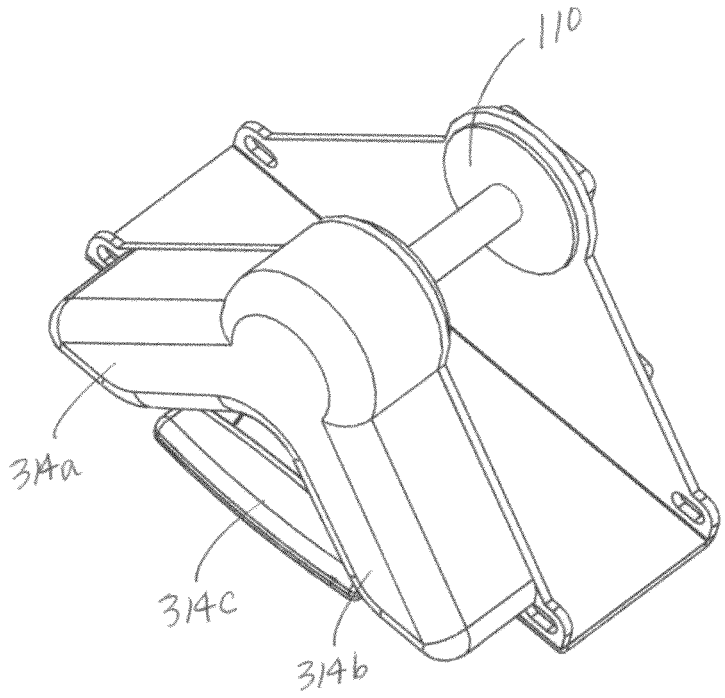
FIG. 6A is a perspective view of a hydraulic damper system for use in a personal escape device in accordance with certain embodiments of the invention.

Another unwind control assembly 200 that may be used in the inventive device 100 includes a hydraulic damper assembly 312, shown in FIG. 6A. In one embodiment, as shown in FIGS. 6B-6E, two hydraulic dampers 314*a*, 314*b* (shock absorbers) are configured in a 50/50 compression/rebound ratio and are attached at a 90 degree angle to a crankshaft 316. At the very top and bottom of the damper stroke, shown in FIG. 6B, there is no resistance as the crankshaft 316 moves perpendicular to the damper 314*c*. However, as the other damper 314*a*, 314*b* rotate and become mounted 90 degrees to the crankshaft 316, it places the damper 314*c* in a position to handle the payload from the cord 106. The result is a smooth and constant motion.

In the illustrated embodiment of FIGS. 1-2, the spool 110 is disposed along a central axis A. The unwind control assembly 200 and the brake system 310 are disposed on an idler shaft 212 which is substantially parallel to the central axis A, coupled by coupler assembly 214. In alternative embodiments, all of these elements could be disposed on a single shaft along central axis A.

Figure 7:
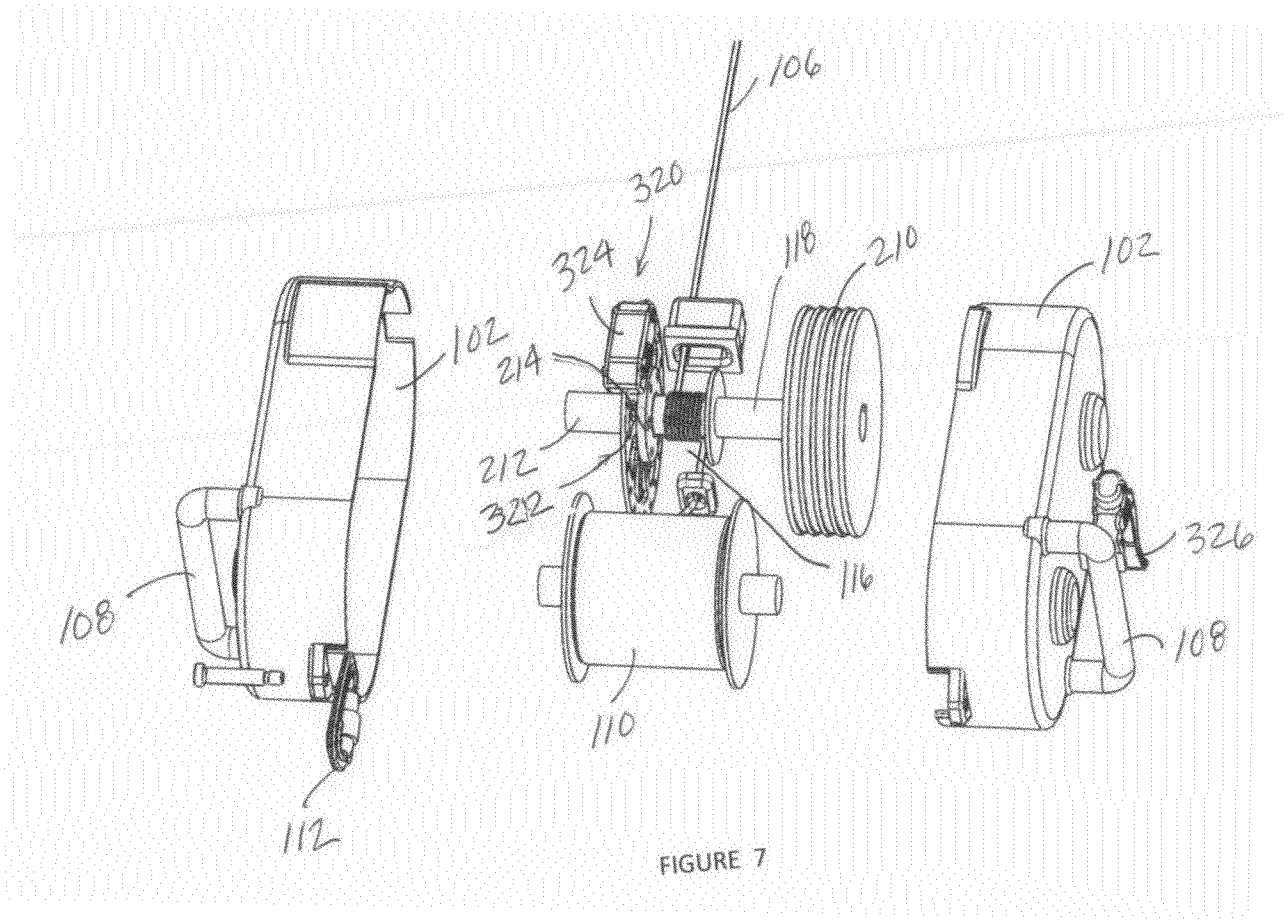
FIG. 7 is an expanded perspective view of a personal escape device in accordance with certain embodiments of the invention.

FIG. 7 shows an alternative form of the inventive device 100, having a secondary spool 116. Depending on the spool geometry and the amount of cord required, a secondary spool 116 may be included on idler shaft 212 that extends parallel to central axis A. The secondary spool 116 enables the spool 110 diameter to change as cord 106 is unwound from the spool 110 during deployment, without changing the torque applied by the payload onto the unwind control assembly 200. The amount of cord 106 required to descend from, for example, 100 stories, is significant and creates a large spool 110 diameter when fully wound. There are one or more windings of cord 106 on the secondary spool 116, preferably all disposed in a single layer, between spool 110 and port 104. Shaft 212 and the secondary spool 116 are coupled to the unwind control assembly 200 (by way of coupling assembly 214) using direct connection, a gear assembly, a chain and sprocket assembly, a belt and pulley assembly, or the like. The secondary spool 116 may alternatively be disposed on a separate idler shaft 118.

The inventive device 100 illustrated in FIG. 7, includes a (user-operated) secondary braking mechanism 320. As in the earlier described embodiment, this secondary braking mechanism 320 allows a user to slow or stop at any point in their descent to avoid people or obstacles that may be encountered along the way down. The illustrated braking mechanism 320 is a hydraulic brake, including a standard braking disc in connection with a brake caliper 324. A brake lever 326 is mounted to a handle 108 for convenient access to the user.

Figure 8:
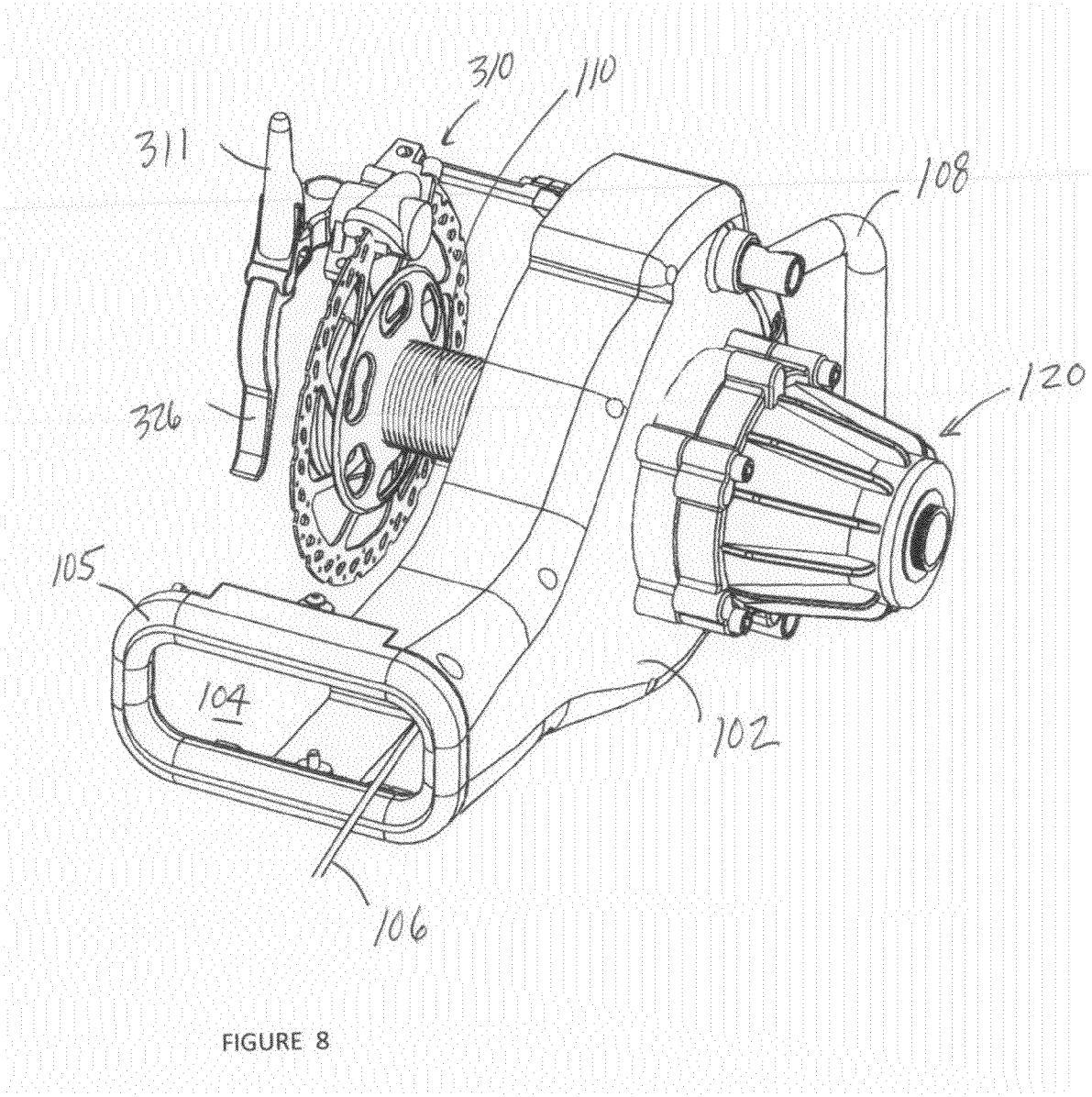
FIG. 8 is a partial cut-away view of a personal escape device in accordance with certain embodiments of the invention, showing a secondary braking mechanism.

FIG. 8 shows a cutaway view of device 100, more clearly showing a secondary braking mechanism 320.

Figure 9A:
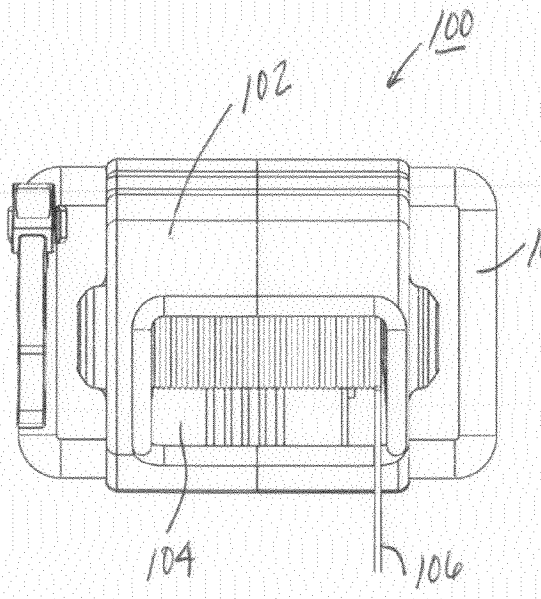
FIG. 9A is a top perspective view of a personal escape device in accordance with certain embodiments of the invention.
Figure 9B:
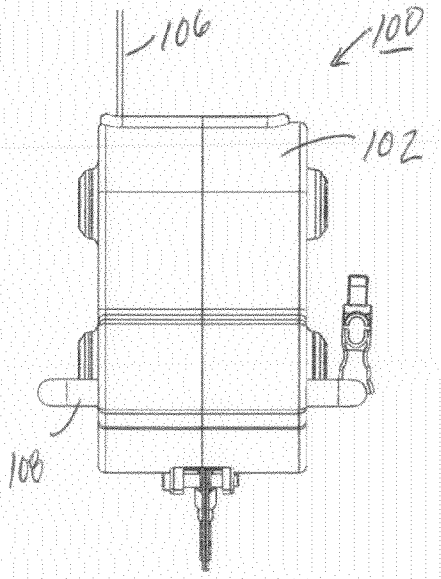
FIG. 9B is a top perspective view of the personal escape device of FIG. 5A.
Figure 9C:
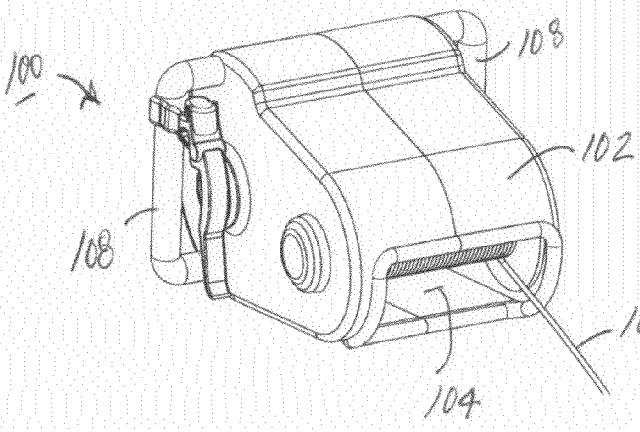
FIG. 9C is a perspective view of the personal escape device of FIGS. 5A and 5B.

FIGS. 9A-9C show alternate perspectives of an embodiment of the inventive device 100. The housing 102 is of a different configuration and shape from the housing shown in FIG. 1, because it is to be used for lower buildings. Thus, the housing 102 may be shaped and sized to adapt to different building heights.

The cord 106 preferably is manufactured from a Kevlar core material or other non-elastic material preferably with load-bearing capacity of 50-300 pounds. The tensile strength for a 3 mm diameter cord typically is 3200 lbs. In alternate embodiments, heat-resistant rope may be used, such as Technora/Kevlar core with a nylon sheath. Due to the diameter of some such ropes, the use of rope may increase the size of the required housing 102, thus the overall size of the device, by a significant amount. Carbon nanotubes and other nano and synthetic cables and cords may be used both for strength and small diameter. Cable of small diameter and high tensile strength allows the size of the device to remain small and reliable. Other materials, such as cords manufactured with Technora, with high tensile strength and high melting point, or Spectra, which is a very high molecular density form of polyethylene, may be used.

Figure 10:
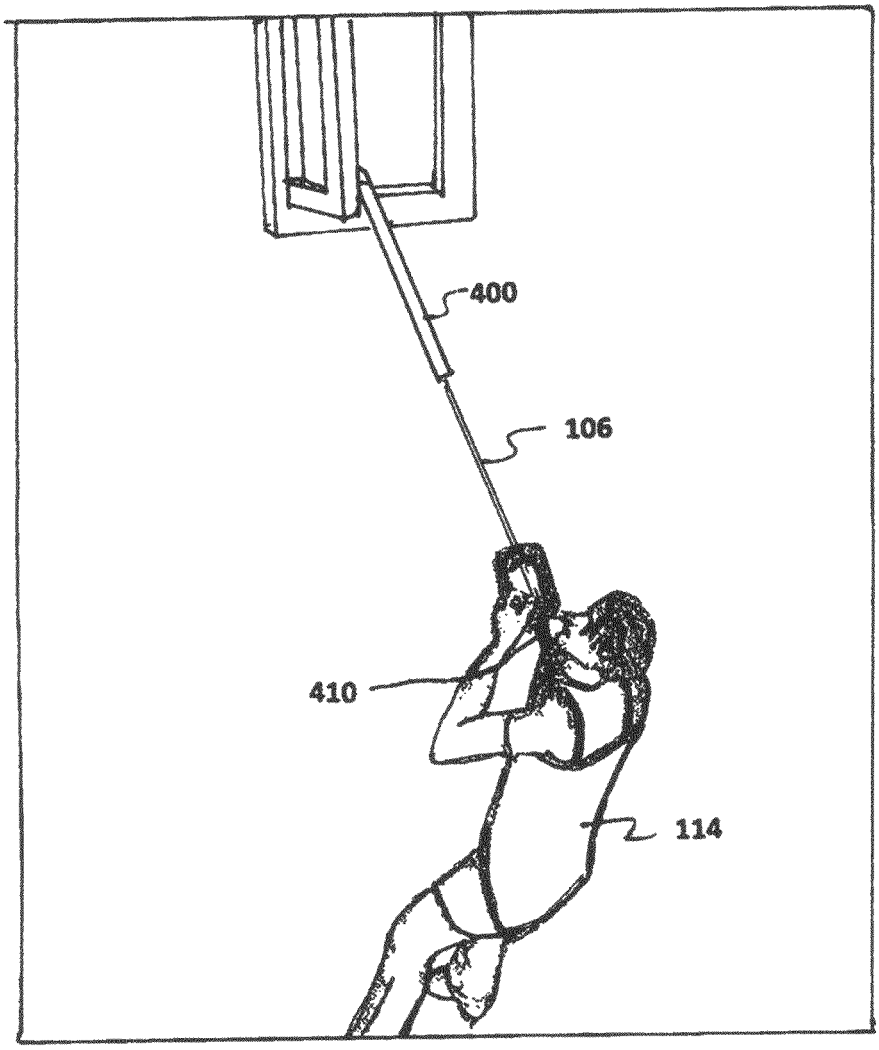
FIG. 10 illustrates a portion of the cord of the personal escape assembly of the present invention.

Cord lengths could vary depending upon the height of the building with which the device 100 is intended to be used. Because one use of the device 100 is for rappelling-like use from building windows that may need to be broken to effectuate an exit from the building, the cord 106 may at its distal end have relatively high abrasion resistance (illustrated by portion 106A in FIG. 1 and section 400 in FIG. 10, to prevent cable wear and breakage from bending the cord over sharp corners of the building exterior. Since a user might traverse somewhat laterally during descent, the high abrasion resistance portion would prevent where as the cord might move in a transverse direction. Thus, including abrasion-resistant portions 106A and 400 at the distal end closest to the building, significant damage to the cord may be avoided. Abrasion resistant portions of cords can be short (e.g., 10-30 foot sections) links of a higher strength cable, metal cable, or sections employing a protective cover. Although the entire cord may be made of or coated with an abrasive resistant material, limiting the amount of abrasive resistant material to a portion of the entire cord length enables more cord to be wound and stored per spool. For taller buildings, it will be desirable for a device 100 to include more length of cord 106 than a device designed for shorter buildings. Devices 100 designed for use in taller buildings may be more compact if the cord 106 can be wound efficiently around the spool 110.

In an embodiment of the inventive device 100, the device includes an impact absorbing member 410 at the proximal end of the cord 106. For example, the impact absorber may be a short elastic "bungee" section 420 provided between the harness 114 and the payload coupler 112. The impact absorbing member 410 reduces the impact forces associated with sudden movements and short falls. By lowering impact forces, a lighter weight cable can be used. Limiting the elastic section 420 to the proximal portion of the cord allows the cord 106 to be wound more compactly about the spool 110, thus enabling the device 100 to include more cord length per device.

Figure 11:
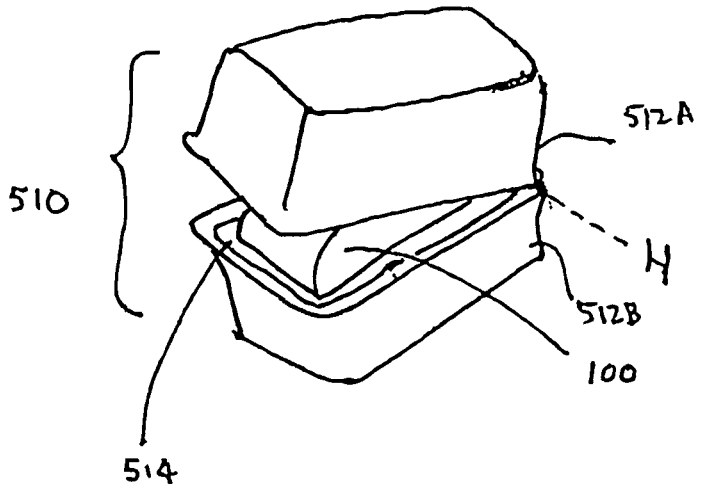
FIG. 11 is a perspective view of personal escape kit of the present invention, including a convertible storage unit together with a personal escape device.

The present invention includes a personal escape assembly, as shown in FIG. 11, which includes a personal escape device 100 described herein, together with a convertible storage unit 510. The storage unit 510 includes an outer impact-resistant storage housing in a two-piece configuration (512A and 512B) coupled by a hinge about axis H. The storage housing 512 may be of any durable material, including fire-resistant material. It may be shaped in any shape convenient for storage of the assembly 500, and of sufficient size to house a personal escape device 100 therein.

Figure 12:
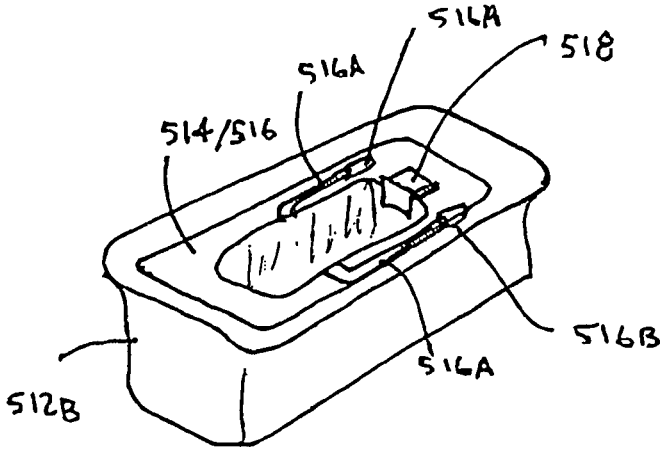
FIG. 12 is a perspective view of personal escape kit of the present invention, including a convertible storage unit together with a personal escape device and a communication device.

As shown in FIG. 12, the storage unit 510 further includes an interior formable impact-absorbent lining assembly 514. This lining assembly 514 is formable about the personal escape device 100, either using malleable, formable materials, or other materials that may be pre-shaped to secure a device 100 stored therein. The lining assembly 514 may be adaptable to form a user-protective portion 516 that allows the user to use the storage unit 510 as a protective helmet during deployment of the device 100. Straps 516A may be used with mating clasps 516B at their distal ends, for securing the piece 512B to a user's head. Alternatively, the user-protective portion 516 may be a series of straps, or other assembly of the type found in bicycle helmets and other commercially available safety helmets. The lining assembly 514 and the user-protective portion 516 may be the same, whereby the lining assembly converts completely or in part into a user-protective portion 516.

One embodiment of the personal escape assembly 500 includes a communication device 518. The communication device 518 may be a two-way or one-way radio communication system of the type generally commercially available. The device 518 may be selectively attachable to or integral with the outer storage housing 512 or the personal escape device housing 102. Alternatively, the communication device 518 may be generally available, without any attachment, within the storage unit 510.

In deploying the personal escape device 100 of the present invention, a user breaks or otherwise opens a window or other exit to a building which the user desires to leave. Once an opening is made, the user opens the convertible storage unit 500 and removes the personal escape device 100. If the user is using a personal escape kit, the user may pull a hinge pin from the hinge, separating pieces 512A and 512B, and don the piece 512B and couple the clasps 516B, thereby turning piece 512B into a protective helmet prior to engaging the device 100.

Figure 13:
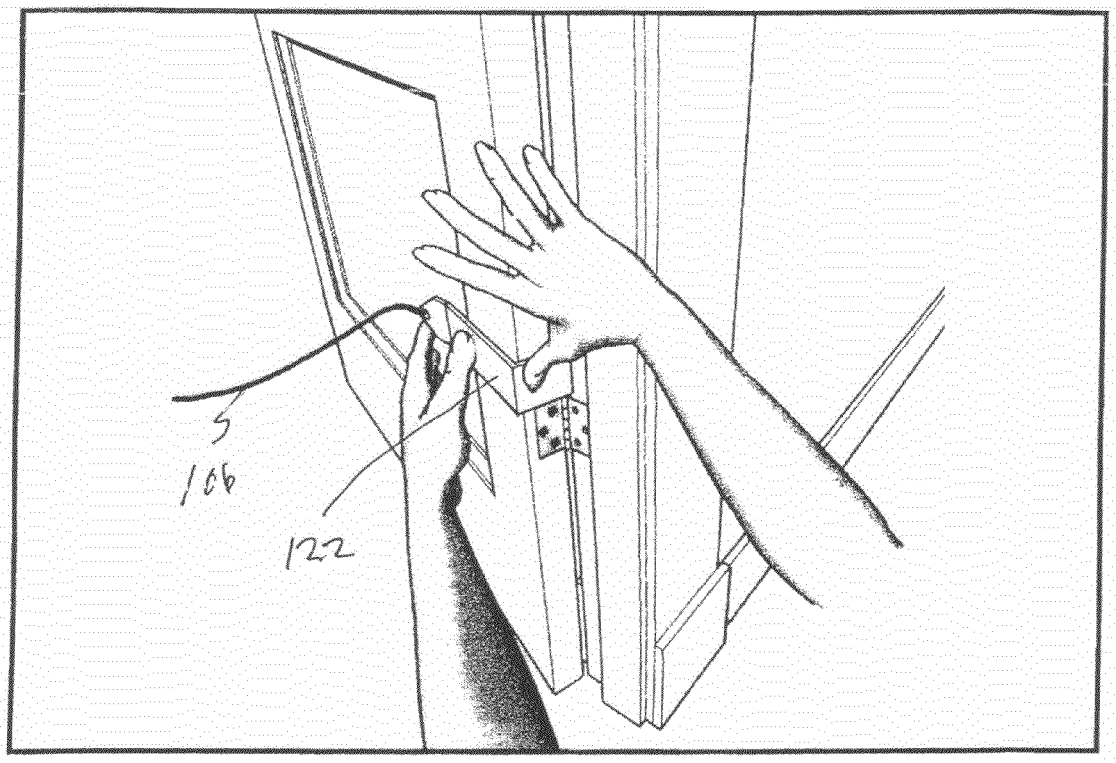
FIG. 13 is an illustration of a user of a personal escape device of the present invention, securing the distal end of the cord in accordance with a method of practicing the present invention.

Next, and as shown in FIG. 13, the user secures the distal end of the cord 106 to a fixed object. The distal end of the cord includes a cord attachment element 122. This element 122 preferably is quick and easy to use in any situation, without the need for any installation. As shown in FIG. 13, the element 122 may be a door clip secured around the edge of a door. Alternatively, the element 122 may include a bar form that uses the strength of all three door hinges, or a mechanism that clips to some other common office feature such as a file cabinet, ventilation vent, and the like. Alternatively, the element 122 may include an explosive cap that, when struck against a surface or otherwise activated, forceably projects a molly-bolt or other element into a floor or wall to securely engage the cord. Such devices, and those of a similar nature, are commercially available and known. Alternatively, a resilient finger clip can be used to secure the distal end to rings rigidly affixed to secure structural elements of the building.

Figure 14:
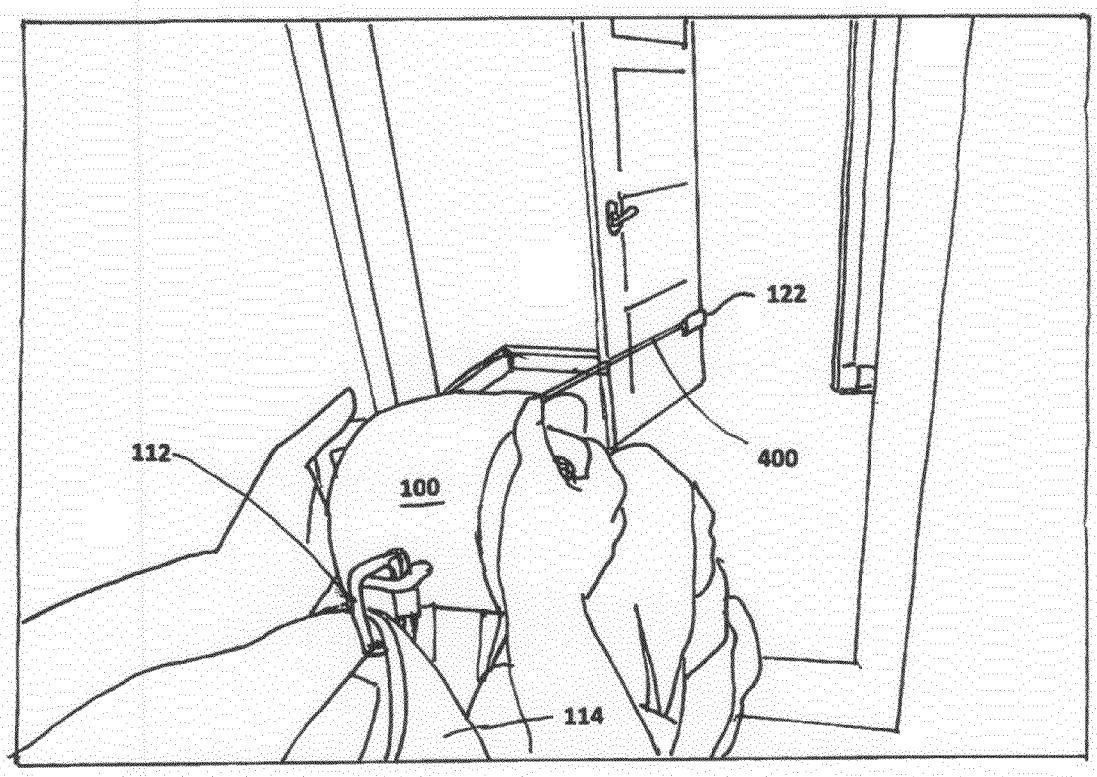
FIG. 14 is an illustration of a personal escape device of the present invention secured to a user and a harness assembly, showing the distal end of the cord attached to an external object, and the user leaning out of a building window just prior to escaping the building in accordance with a method of practicing the present invention.
Figure 15:
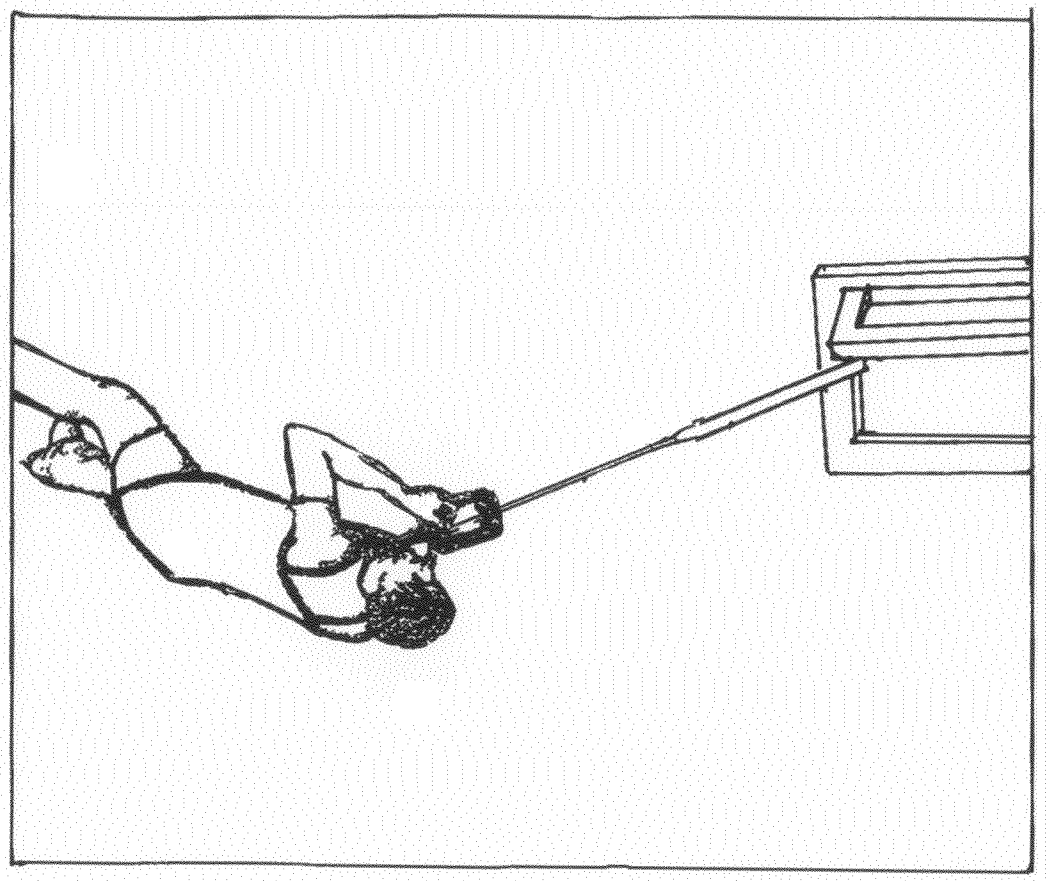
FIG. 15 is an illustration of a user descending along the outside wall of a building in accordance with a method of practicing the present invention.

Once the cord attachment element 122 is in position, the user dons the harness 114, and attaches the personal escape device 100 to the harness 114 using the payload coupler 112, as shown in FIG. 14. The user then backs up until perched on the window ledge or other identified exit and, in a rappelling manner, as shown in FIG. 15, descends down the side of the building.

The foregoing detailed description has been provided for a better understanding of the invention only, and some modifications will be apparent to those skilled in the art without deviating from the spirit and scope of the appended claims.

We claim:

1. A personal escape device, comprising:

A. a housing having a port,

B. a primary spool extending along a central axis and disposed within said housing opposite said port, said primary spool being rotatably coupled to said housing to permit rotation of said primary spool about said central axis, C. an elongated cord having a proximal end and a distal end, said proximal end being affixed to said primary spool and said distal end extending through said port, said cord including a plurality of windings around said primary spool, D. an anchor assembly extending from said distal end of said cord, including means for selectively coupling said distal end of said cord to an external object, E. a payload coupler affixed to said housing for receiving a harness assembly for supporting a payload, F. an unwind control assembly including i. a secondary spool having a cylindrical core coupled to an idler shaft extending along an axis displaced from and parallel to said central axis, and wherein said cord includes two or more mutually adjacent, single-layer full windings around said cylindrical core of the secondary spool between said primary spool and said port, and ii. a centrifugal clutch disposed on a secondary shaft coupled to said housing and extending along an axis displaced from and parallel to said central axis, for controlling the rate of exit of said cord from said housing to be a predetermined function of time in response to a substantially constant pulling force on said distal end, wherein said secondary shaft is said idler shaft, and G. a manual brake assembly coupled to at least one of the idler shaft and the primary spool responsive to a user-applied external force to selectively limit the outplay of the cord from the housing.

2. A device according to claim 1 wherein said unwind control assembly includes a user controllable disc brake connected by a coupling assembly between said primary spool and said housing.

3. A device according to claim 2 wherein said disc break is disposed on an idler shaft coupled to said housing and extending parallel to said central axis.

4. A device according to claim 3 wherein said coupling assembly is one from the group consisting of a direct connection, a gear assembly, a chain assembly, and a belt assembly.

5. A device according to claim 1 wherein a portion of said cord at or near said distal end has a relatively high abrasion resistance compared to the remainder of said cord.

6. A device according to claim 1 wherein said payload coupler includes an impact absorbing member adapted to be coupled in line between said distal end of said cord and a harness assembly received thereto.

7. A device according to claim 6 wherein said impact absorbing member is a resilient elastic cord.

8. A device according to claim 1, further comprising a harness adapted for supporting a payload, said harness including a harness coupler for attaching said harness assembly to said payload coupler.

9. A device according to claim 8 wherein said harness coupler is selectively operable to attach said harness assembly to said payload coupler.

10. A device according to claim 1 further comprising a dashpot coupled between said primary spool and said housing.

11. A device according to claim 1 wherein said unwind control assembly includes a hysteresis brake.

12. A device according to claim 1 wherein said unwind control assembly includes an electromagnetic brake.

13. A device according to claim 1 wherein said unwind control assembly includes an eddy current brake.

14. A personal escape kit, comprising:

a personal escape device, said device comprising:

a housing having a port, a primary spool extending along a central axis and disposed within said housing opposite said port, said primary spool being rotatably coupled to said housing to permit rotation of said primary spool about said central axis, an elongated cord having a proximal end and a distal and, said proximal end being affixed to said primary spool and said distal end extending through said port, said cord including a plurality of windings around said primary spool, an anchor assembly extending from said distal end of said cord, including means for selectively coupling said distal end of said cord to an external object, a payload coupler affixed to said housing for receiving a harness assembly for supporting a payload, an unwind control assembly including i. a secondary spool having a cylindrical core coupled to an idler shaft along an axis displaced from and parallel to said central axis, and wherein said cord includes two or more mutually adjacent, single-layer full windings around the cylindrical core of said secondary spool between said primary spool and said port, and ii. a centrifugal clutch disposed on a secondary shaft coupled to said housing and extending parallel to said central axis, for controlling the rate of exit of said cord from said housing to be a predetermined function of time in response to a substantially constant pulling force on said distal end, wherein said secondary shaft is said idler shaft, and a manual brake assembly coupled to at least one of the idler shaft and the primary spool responsive to a user-applied external force to selectively limit the outplay of the cord from the housing, and a convertible storage unit, comprising an outer impact-resistant storage housing, an interior formable impact absorbent lining assembly, wherein said lining assembly further comprises a retaining portion adaptable to securely retain said personal escape device therein and further adaptable to secure said storage unit on a user's head.

* * * * *